United States Patent [19]

Palmer

[11] 4,059,256

[45] Nov. 22, 1977

[54] LOADING RACK FOR MINICOMPUTER

[76] Inventor: Sherwin Palmer, 3401 E. Court St., Flint, Mich. 48501

[21] Appl. No.: 703,019

[22] Filed: July 6, 1976

Related U.S. Application Data

[63] Continuation of Ser. No. 598,279, July 23, 1975, abandoned.

[51] Int. Cl.[2] ..... B65H 39/00

[52] U.S. Cl. ..... 270/52; 270/52.5; 197/133 F

[58] Field of Search ..... 270/52.5, 52, 61 F; 197/133 F, 133 P; 211/208, 176; 282/11.5 A, 12 R, 12 A, 12 B

[56] References Cited

U.S. PATENT DOCUMENTS

| | | | |
|---|---|---|---|
| 1,616,071 | 2/1927 | Waldheim | 197/133 F |
| 1,656,153 | 1/1928 | Smith | 197/133 F |
| 2,018,052 | 10/1935 | Caton | 197/133 F |
| 3,013,646 | 12/1961 | Sargent | 197/133 F |
| 3,134,474 | 5/1964 | Marchman | 197/133 F |
| 3,171,541 | 3/1965 | Weisberger | 211/176 |
| 3,199,683 | 8/1965 | Graswich | 211/208 |
| 3,280,989 | 10/1966 | Melvin | 211/176 |

*Primary Examiner*—Edward M. Coven
*Assistant Examiner*—A. Heinz
*Attorney, Agent, or Firm*—Lowe, King, Price & Markva

[57] ABSTRACT

In a method and system for feeding prefolded recording web to a business machine, such as a computer, a plurality of receptacles containing the recording web are stored on upper and lower shelves of a portable rack positioned adjacent the computer. The shelves are spaced apart from each other by a distance sufficient to provide unobstructed flow of recording web from each of the receptacles to the computer. Any interference to the flow of recording web by the receptacles themselves is prevented by horizontal guide members attached to the rack. In one embodiment, the upper shelf has a width that is less than that of the lower shelf. This permits the rack to be located closely adjacent the computer while providing unobstructed flow of recording web to the computer from receptacles located on the lower shelf. In another embodiment, the lower shelf extends horizontally beyond the upper shelf to receive an additional receptacle for collecting recording web outfed from the computer. A horizontal guide member, located above the upper shelf, guides outfed recording web to the additional receptacle.

3 Claims, 11 Drawing Figures

LOADING RACK FOR MINICOMPUTER

This is a Continuation of co-pending application Ser. No. 598,279, filed 7/23/75, now abandoned.

BACKGROUND OF THE INVENTION

The present invention relates generally to methods and systems for feeding recording web to business machines, and more particularly to a method and compact system for feeding prefolded recording web to a computer from a plurality of sources of the web.

In modern business practice, record keeping is often provided by programmable digital computers. For example, the computer may be programmed to receive information reflecting daily sales, operate on the sales information along with data stored in the memory of the computer, and generate billing and inventory control information.

Generally, data are supplied to the computer and generated therefrom on continuous prefolded sheets of recording web. Different forms are printed on the prefolded sheets depending on the particular program used in the computer for each job. Forms used with different programs differ from each other in size, color, format and ply. Each time the program is changed, it may be necessary to supply a different type of prefolded recording web to the computer. This requires a large number of different sources of prefolded recording web to be on hand in proximity to the computer so that forms can be quickly changed when there is a change in program. Heretofore, the general practice has been to dispose a large number of different forms on the floor adjacent the computer. The forms are manually shifted to the computer as needed.

In some applications, two different types of forms are simultaneously supplied to the computer. When there is a program change, the relative position of the two forms often has to be reversed, or the location of only one of the forms has to be shifted. At the end of a program run, forms may have to be transported from the computer to a remote line printer. The result is that the floor of the computer room becomes cluttered with piles of different forms, and excessive manual work is required to shift the various forms to different locations as needed.

Accordingly, a primary object of the present invention is to provide a new and improved method and system for loading a business machine with recording web from any of a plurality of sources of the web.

Another object of the present invention is to provide a new and improved method and system for feeding a business machine with recording web from a plurality of sources of the web, wherein shifting of the sources during program change-over is minimized.

Another object of the present invention is to provide a new and improved method and system for loading a business machine with prefolded recording web wherein storage and transportation of the web are simplified.

Another difficulty incurred during office use of a computer is that the piles of prefolded recording web must be carefully aligned to the computer. There must be an interference-free flow path of web to the computer to avoid undesirable angling of the recording web with respect to the platen or other feeding device in the computer, and to avoid ripping the recording web at the serrations between adjacent prefolded sheets of the web.

To prevent interference to the flow of the recording web to the computer, it is necessary to provide an unobstructed flow path between each of the sources of recording web and the computer. Heretofore, guides attached to the computer, as exemplified in U.S. Pat. No. 2,018,052, have been used to maintain the recording web spaced away from the body of the computer and properly aligned during in-feed to the computer from sources of recording web stored on a rack. While generally somewhat satisfactory, the guides do not prevent interference to flow caused by the stacks of recording web or by the rack itself. As another disadvantage, the guides for the recording web protrude from the computer, requiring additional floor space and interfering with traffic flow at the computer.

For many programmed operations, multiple ply prefolded recording web is supplied to the computer by separating the individual plies and feeding them into separate input portions of the computer. Heretofore, ply separation of multiple ply recording web has required relatively complex apparatus, and the separated plies are individually fed to the computer in an additional operation. Excessive floor space is required for the ply separation apparatus, and the requirement of separately feeding the individual plies to the computer reduces operating efficiency.

Accordingly, another object of the present invention is to provide a means for supplying prefolded recording web to a business machine along unobstructed flow paths while utilizing a minimum amount of floor space.

Another object of the present invention is to provide a means for separating the individual plies of multiple ply web while feeding the web to a business machine.

SUMMARY OF THE INVENTION

In accordance with the invention, a portable rack for storing a plurality of receptacles containing prefolded recording web includes upper and lower adjustable shelves for supporting the receptacles adjacent the web receiving portion of a business machine, such as a computer. During set-up, the shelves are spaced apart from each other by a distance sufficient to ensure an unobstructed flow of recording web from receptacles stored on the shelves to the computer. Horizontal guides, attached to the rack, guide the recording web from the receptacles to the computer and prevent interference to flow by any of the receptacles or by the rack itself. The rack is mounted on wheels so that receptacles containing different formats of recording material (forms) can be easily shifted during program changeover.

In one embodiment, the rack comprises an inverted U-shaped frame attached to the lower shelf which is, in turn, mounted on wheels. Only a lower portion of the wheels extends below the lower shelf in order to maintain the shelf low to the floor to minimize the amount of lifting required to load the rack. The upper shelf is attached to the frame with bolts and is adjustable so that the spacing between the shelves can be varied to accommodate receptacles of various sizes stored on the lower shelf.

Receptacles are stored on the upper and lower shelves on both sides of the frame. A first horizontal guide member, attached to the rack, is located between the upper and lower shelves to prevent interference to recording web outfed from receptacles stored on the lower shelf, caused by contact with one of the receptacles or with the rack itself. As mentioned, interference to flow of recording web by the upper shelf is avoided by the spacing between shelves. A second horizontal guide member, attached to the rack, guides the flow of recording web from the receptacles on the upper shelf to the computer. The unobstructed flow path from the receptacles to the computer provided by the horizontal guide members, as well as by the spacing between the shelves, prevents the recording web from ripping along serrations formed between adjacent sheets, and prevents misalignment or "angling" of the recording web at the input of the computer.

In another embodiment of the invention, the lower shelf extends horizontally beyond the upper shelf to accommodate an additional receptacle for collecting recording web (which is outfed from the computer above the infed web). Since the lower shelf is maintained low to the floor, gravity assists the flow of recording web to the additional receptacle. A third horizontal guide member, attached to the rack, is located above the second guide member to space the outfed recording web away from the rack and guide it to the additional receptacle.

In another embodiment, a pair of A-shaped frame members are attached to the lower shelf, which is in turn mounted to wheels. The upper shelf is selectively seated on one set of a series of sets of ridges formed along the frame members, permitting the height of the upper shelf to be adjusted during set-up. The upper shelf is centrally located on the rack but has a width less than that of the lower shelf. The lower shelf supports at least two standard size receptacles in juxtaposition to each other containing prefolded recording web, while the upper shelf supports a single receptacle above the abutting edges of the receptacles located on the lower shelf. The generally triangular storage configuration provided by the rack allows the rack to be abutted against the computer with an unobstructed flow of recording web being provided from each of the receptacles on the lower shelf to the computer.

A horizontal guide member, attached to the rack, is located over the upper shelf to guide recording web from the receptacle on the upper shelf to the computer. The guide member is also used to separate the individual plies of two-ply recording web by passing the plies past opposite sides of the guide member during infeed to the computer.

The above and still further objects, features and advantages of the present invention will become apparent upon consideration of the following detailed description of specific embodiments thereof, especially when taken in conjunction with the accompanying drawing.

DETAILED DESCRIPTION OF THE PREFERRED EMBODIMENTS

Figure 1:
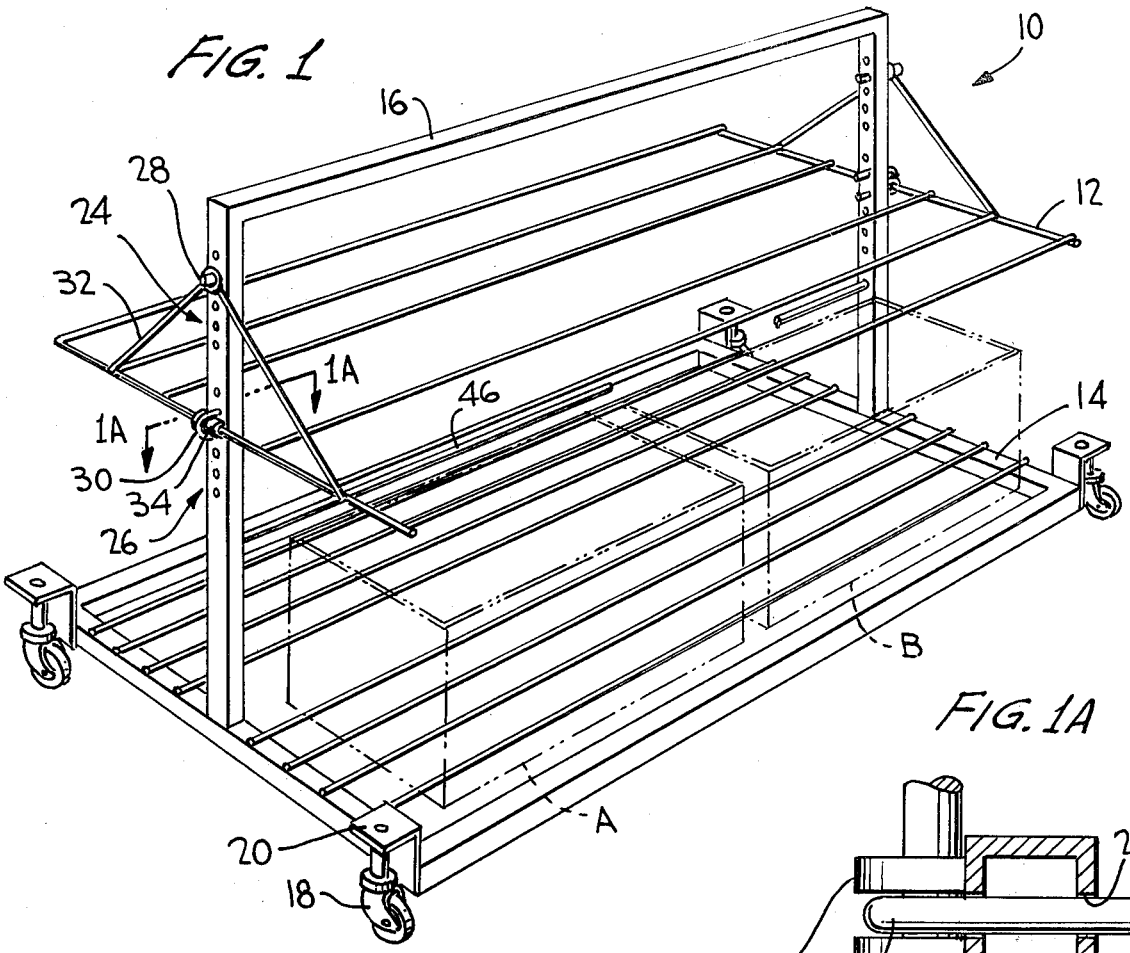
FIG. 1 is a perspective view of one embodiment of the invention.

Referring to FIG. 1, in accordance with one embodiment of the invention, a rack 10 comprises an upper shelf 12 supported by an inverted U-shaped frame 16 which is, in turn, mounted on a lower shelf 14. A set of wheels 18 is attached to the lower shelf 14 with upstanding brackets 20. In order to maintain rack 10 low to the floor for ease of loading, wheels 18 are welded to the top of brackets 20 and extend downwardly therefrom with only a portion of the wheels extending below shelf 14.

Figure 1A:
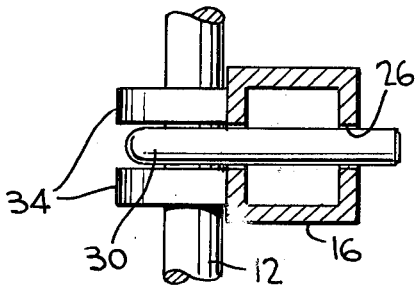
FIG. 1A is a detail of the shelf fastening means.

Each side of frame 16 contains sets of apertures 24 and 26 to receive pins 28 and 30 which support upper shelf 12. With upper shelf 12 mounted to frame 16 at a preselected height, pin 28 extends through an eye of brace 32, and pin 30, which is U-shaped, grips shelf 12. Tabs 34, formed on shelf 12, prevent side play of the shelf when it is mounted to the frame 16 (See FIG. 1A).

The lengths of shelves 12 and 14 are equal to each other and are large enough to accommodate, on each side of frame 16, two receptacles containing standard size prefolded recording web for computers. The height of upper shelf 12 is adjusted by means of pins 28 and 30 to provide clearance to the top of any receptacle placed on lower shelf 14 as discussed in more detail below.

Figure 2:
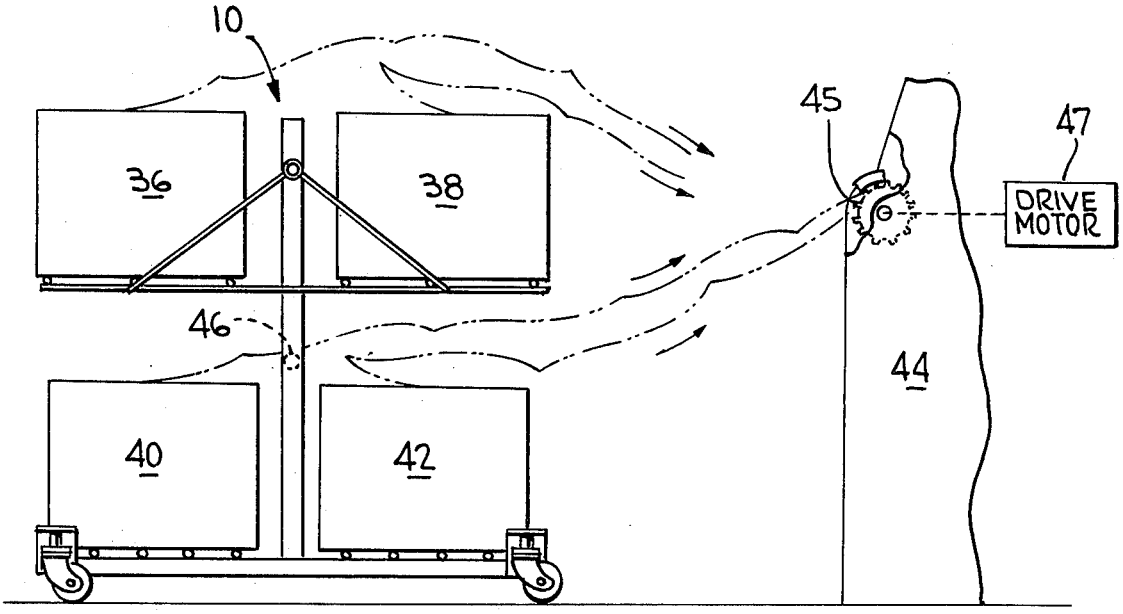
FIG. 2 is a side view of the embodiment of FIG. 1 along with a computer.

Referring to FIG. 2, receptacles 36, 38, 40 and 42 containing prefolded recording web, are supported on rack 10 adjacent a standard programmed digital computer or minicomputer 44. Recording web supplied to computer 44 is drawn by sprocket 45 driven by motor 47. For some applications, at least two sources of recording web are simultaneously supplied from receptacles 36–42 to computer 44, but more commonly, the sources are supplied in succession. In the former case, recording web may be supplied to computer 44 simultaneously from two receptacles displaced from each other vertically as well as horizontally (e.g., from upper receptacle 38 in position B and lower receptacle 42 in position A in FIGS. 1 and 2). During set-up, the height of upper shelf 12 is adjusted on frame 16 so that the shelf is spaced apart from the top of the largest receptacle on lower shelf 14 by at least approximately three inches to permit recording web stored in lower receptacles 40 and 42 to "fan out" without interference from upper shelf 12.

While stored on rack 10, receptacles 3642 are maintained substantially parallel to each other and to computer 44. This prevents recording web outfed from the receptacles from tearing along serrations, preformed between adjacent sheets of the web, due to non-parallel out-feed, and also prevents the web from entering the computer at an angle creating folding or ripping. In this regard, a first cylindrical guide member 46 (see also FIG. 1) guides recording web outfed from receptacle 40 to computer 44 and prevents interference of the web with other web being outfed from receptacle 42. Although not shown, an additional guide member may be located immediately above guide member 46 to vertically stabilize the web and further prevent interference with upper shelf 12.

Of particular importance, rack 10 can be freely transported from one side of computer 44 to the other, or to a remote line printer without disturbing the relative parallel alignment of the receptacles. In addition, no lifting or sliding of the receptacles is required, and vertical stacking reduces the amount of floor space needed.

Figure 3:
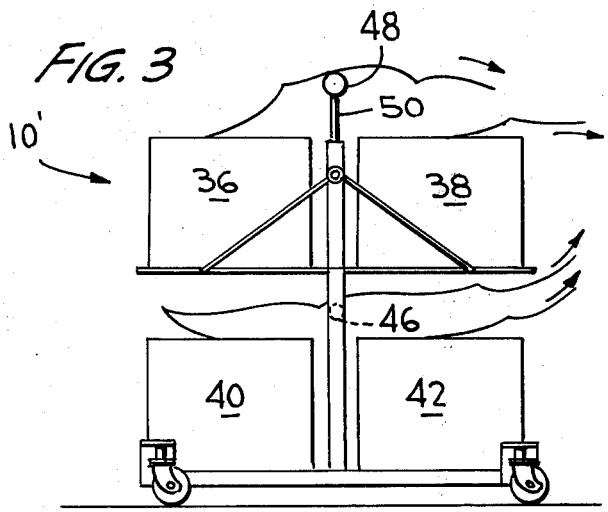
FIG. 3 is a side view of the embodiment of FIG. 1 including a pair of horizontal guide members.

Referring to FIG. 3, in order to guide web outfed from receptacle 36, a second cylindrical guide member 48 is attached to rack 10 through standoff 50. Guide member 48 is horizontal (similar to guide member 46 in FIGS. 1 and 2) and spaces recording web from receptacle 36 away from frame 16 and receptacle 38 to prevent interference to web flow. It should be noted that since guide members 46 and 48 are attached to rack 10, rather than to computer 44 or to an external support means, the receptacles remain parallel to the guide members despite any manual shifting of the rack relative to the computer. In addition, guide members 46 and 48 ensure smooth outflow of recording web from receptacles 36 and 40 without any entanglement of the web between receptacles 36 and 38 or receptacles 40 and 42, and the cylindrical configuration of the guides prevents any creasing of the web.

Figure 4:
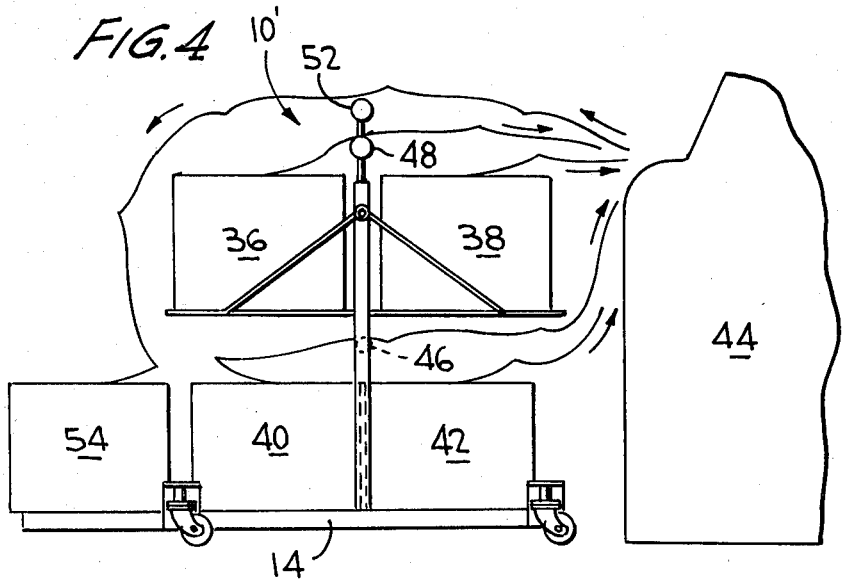
FIG. 4 is a side view of another embodiment of the invention.

Another embodiment of the invention is shown in FIG. 4 wherein an additional horizontal guide member 52, attached to rack 10', is located above guide member 48, and lower shelf 14 extends horizontally beyond upper shelf 12 to accommodate an additional receptacle 54 for collecting recording web outfed from the computer. As shown, guide member 52 maintains outfed recording web spaced away from the web supplied from receptacle 36, and ensures an unobstructed flow path to the additional receptacle 54. Outfed recording web is drawn downwardly toward receptacle 54 by gravity; I have found that after several prefolded sheets of the recording web are manually assisted into receptacle 54, the weight of the initial sheets draws the recording web into the receptacle as the web is outfed from computer 44. Although not shown, an additional guide member can be attached to the left hand side of the upper shelf 12 to help maintain outfed recording web spaced away from receptacle 36.

Figure 5:
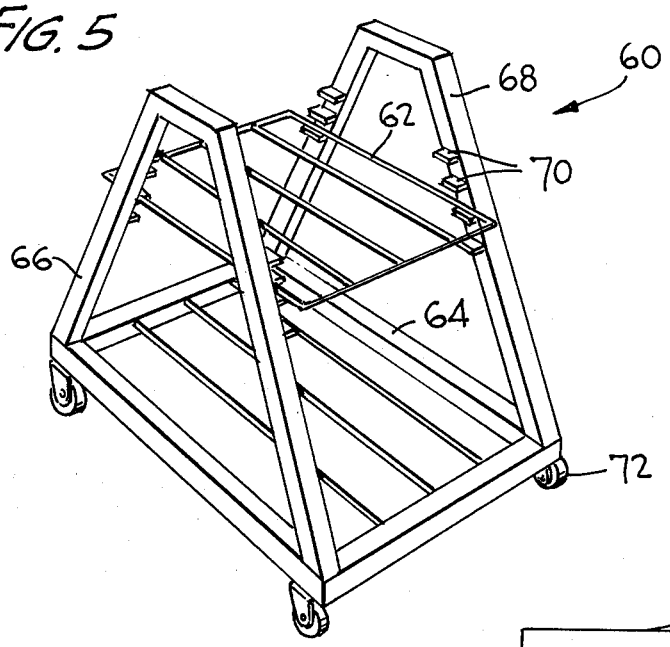
FIG. 5 is a perspective view of another embodiment of the invention.
Figure 6:
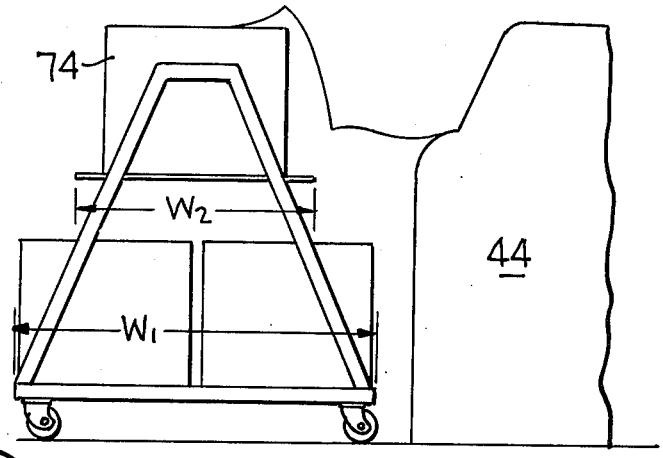
FIG. 6 is a side view of the embodiment of the invention of FIG. 5 with recording web being supplied from a first receptacle to the computer.

Referring now to FIG. 5, in another embodiment of the invention, rack 60 includes an upper shelf 62 supported by a pair of A-shaped frame members 66 and 68. Frame members 66 and 68 are attached to lower shelf 64 which is, in turn, mounted on wheels 72. Upper shelf 62 is seated on ridges 70 formed on frames 66 and 68 (see also FIG. 9*a*). Ridges 70 permit vertical adjustment of upper shelf 62 during set-up, as discussed with respect to rack 10. Of particular importance, upper shelf 62 has a width $W_1$ that is less than the width $W_2$ of lower shelf 64, more clearly seen with reference to FIG. 6.

Figure 7:
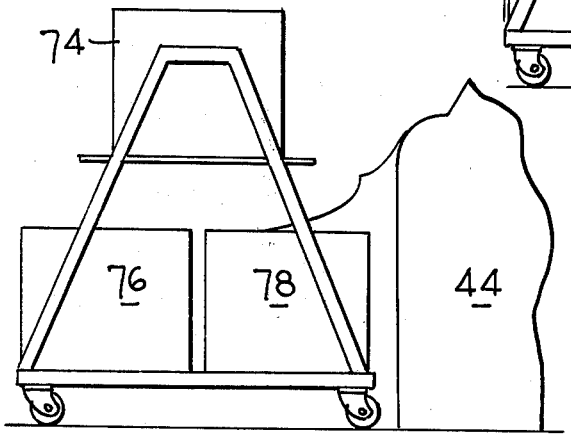
FIG. 7 is a side view of the embodiment of FIG. 5 with recording web being supplied from another receptacle to the computer.
Figure 8:
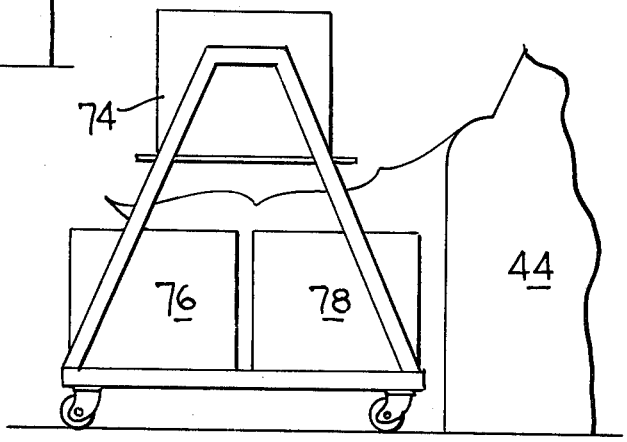
FIG. 8 is a side view of the embodiment of FIG. 5 with recording web being supplied from another receptacle to the computer.

The approximately triangular stacking arrangement of receptacles 74, 76, and 78, as provided by rack 60, stabilizes the rack by maintaining a low center of gravity. The triangular configuration also permits recording web to be supplied to computer 44 from any of the receptacles without interference. For example, in FIG. 6, recording web is supplied from upper receptacle 74 directly to computer 44. When there is a program changeover, or when the supply of recording web in receptacle 74 is exhausted, receptacle 78, for example, may be used to supply recording web to computer 44 as shown in FIG. 7. Since, as aforementioned, the width of shelf 62 is less than that of lower shelf 64, recording web is supplied from receptacle 78 directly to computer 44 without interference by shelf 62. Similarly, when recording web is supplied to computer 44 from receptacle 76, as shown in FIG. 8, there is an unobstructed flow path between receptacle 76 and computer 44. This is true even though rack 60 is in abutment with computer 44 to reduce the use of floor space. Should any interference in flow from receptacle 76 or 78 to computer 44 be encountered due to contact with upper shelf 62, the upper shelf is simply raised to a higher set of ridges 70 on frames 66 and 68 to increase the clearance between the upper shelf and the receptacles.

Figure 9:
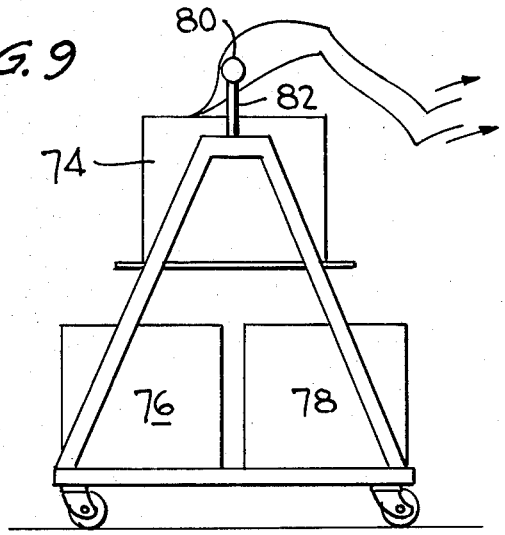
FIG. 9 is a side view of the embodiment of FIG. 5 including a horizontal guide member for separating two-ply recording web.
Figure 9A:
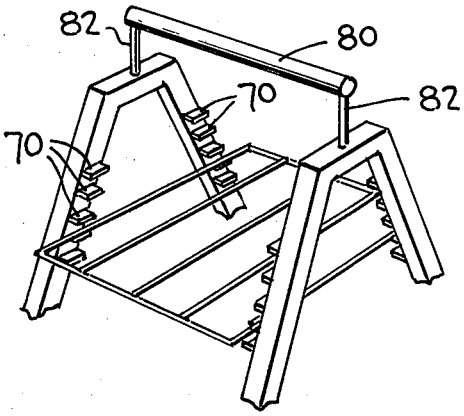
FIG. 9*a* is a detailed view of an upper portion of the embodiment shown in FIG. 9.

In some applications, two-ply recording web is supplied to computer 44 for generating multiple copy output data, for example. In such cases, it is often desirable to separate the individual plies from each other prior to infeed of the web to the computer. In order to minimize tearing, it is necessary to separate the plies as early as possible in the flow path. Referring to FIGS. 9 and 9*a*, a cylindrical guide 80, offset from the top of rack 60 by standoffs 82, is disposed above receptacle 74 containing two-ply recording web. The two-ply recording web is separated by feeding each ply past opposite sides of guides 80. The cylindrical configuration of guide 80 gently separates the two-ply recording web before it is infed to the computer. Although not shown, it is possible to stack additional guides similar to guide 80 to separate multiple-ply recording web having more than two plies.

While I have described and illustrated several specific embodiments of my invention, it will be clear that variations of the details of construction which are specifically illustrated and described can be made. For example, guides 46, 48, 52 and 80 may be formed of cylindrical rollers, rather than rods, to assist the flow of web. Accordingly, it is apparent that the invention can be practiced otherwise than as specifically described herein.

What is claimed is:

1. In combination:

a business machine including an elongate web intake member having a longitudinal axis, and means for advancing multiple ply, prefolded web to said machine, said machine including means for printing data onto the multiple ply, prefolded web; and rack means providing a generally triangular storage web configuration for feeding multiple ply, prefolded web between a plurality of sources of multiple ply, prefolded web and said machine, including a pair of A-shaped frame members supporting first and second planar, horizontal shelves, said first shelf having a first width and supporting first and second receptacles containing multiple ply, prefolded web, said first and second receptacles substantially abutting each other along a vertical plane parallel to the axis of the web intake member of said business machine; said second shelf having a second width that is less than said first width and located above said first shelf at a height sufficient to permit fan out of the multiple ply, prefolded web from said first and second receptacles, said second shelf supporting a third receptacle containing multiple ply, prefolded web symmetrically about said vertical plane; and a horizontal member attached to said rack means, said member being spaced apart from said second shelf and having a body portion for separating individual plies of multiple ply, prefolded web from each other by passing the individual plies past opposite sides of the body portion while guiding said multiple ply, prefolded webs from each of the three receptacles to the intake member of said business machine.

2. A method of successively supplying prefolded web to a business machine without obstruction from a plurality of receptacles containing multiple ply, prefolded web, said business machine including means for printing data onto said web, and an elongate intake member having a longitudinal axis and means for advancing the web from each of said receptacles to said machine; comprising the steps of:

orienting first, second and third receptacles containing multiple ply, prefolded web into a triangular storage configuration having a low center of gravity by positioning said first and second receptacles on a common horizontal plane in substantial abutment to each other along a vertical plane parallel to the axis of the web intake member of said machine and with said second receptacle substantially abutting said machine, and horizontally positioning a third receptacle containing multiple ply, prefolded web symmetrically about said vertical plane above said first and second receptacles at a height sufficient to permit unobstructed fan out of the multiple ply, prefolded web from said first and second receptacles to said machine;

feeding the multiple ply, prefolded webs successively from said first, second and third receptacles along unobstructed flow paths to the web intake member of said machine; and decollating the multiple ply, prefolded web from each of said receptacles early in the web flow paths from said receptacles to said machine by passing individual plies of the respective multiple ply, prefolded webs along opposite sides of a horizontal member positioned in proximity to said vertical plane above said third receptacle while guiding at least one ply of each multiple ply, prefolded web to the intake member of said machine.

3. A method of successively supplying prefolded recording web without obstruction to a business machine from first, second and third receptacles containing webs, said business machine including an elongate intake member having a longitudinal axis and means for advancing the web to said machine, comprising the steps of:

orienting first, second and third receptacles containing prefolded recording webs into a triangular storage configuration having a low center of gravity by positioning the first and second receptacles on a common lower horizontal plane in substantial abutment to each other along a vertical plane parallel to the axis of the web intake member of said machine, and with said second receptacle substantially abutting said machine, and positioning the third receptacle containing prefolded recording web on an upper horizontal plane and substantially symmetrically about said vertical plane above said first and second receptacles at a height sufficient to permit unobstructed fan out of the prefolded webs from said first and second receptacles to said machine; and feeding the prefolded webs successively from said first, second and third receptacles along unobstructed flow paths to the web intake member of said machine, including feeding the prefolded recording web from said first receptacle to said intake member along a first path passing between said upper and lower horizontal planes with only said web from said first receptacle passing through said vertical plane and over a full width of said second receptacle, and feeding the prefolded recording web from said second receptacle to said intake member along a second path between said upper and lower horizontal planes.

* * * * *